US009475318B2

(12) United States Patent
Matsuhashi

(10) Patent No.: US 9,475,318 B2
(45) Date of Patent: Oct. 25, 2016

(54) PRINTING METHOD

(71) Applicant: SEIKO EPSON CORPORATION, Tokyo (JP)

(72) Inventor: Kunihiko Matsuhashi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 267 days.

(21) Appl. No.: 13/950,603

(22) Filed: Jul. 25, 2013

(65) Prior Publication Data

US 2013/0307888 A1 Nov. 21, 2013

Related U.S. Application Data

(63) Continuation of application No. 13/027,363, filed on Feb. 15, 2011, now Pat. No. 8,517,377.

(30) Foreign Application Priority Data

Feb. 24, 2010 (JP) ..... 2010-039142

(51) Int. Cl.

| | |
|---|---|
| ***B41J 29/00*** | (2006.01) |
| ***B41J 3/407*** | (2006.01) |
| ***B41J 11/00*** | (2006.01) |
| ***B65B 61/02*** | (2006.01) |
| ***B65B 61/26*** | (2006.01) |
| ***B65H 5/22*** | (2006.01) |

(52) U.S. Cl.

CPC ..... *B41J 29/00* (2013.01); *B41J 3/407* (2013.01); *B41J 11/007* (2013.01); *B41J 11/0085* (2013.01); *B65B 61/025* (2013.01); *B65B 61/26* (2013.01); *B65H 5/224* (2013.01); *B65H 2301/5124* (2013.01); *B65H 2406/30* (2013.01); *B65H 2601/211* (2013.01); *B65H 2701/191* (2013.01)

(58) Field of Classification Search

CPC ..... B41J 29/00; B41J 3/407; B41J 11/007; B41J 11/0085; B65B 61/025; B65B 61/26; B65H 5/224; B65H 2301/5124; B65H 2406/30; B65H 2601/211; B65H 2701/191

USPC ..... 271/272

See application file for complete search history.

(56) References Cited

U.S. PATENT DOCUMENTS

| | | | | |
|---|---|---|---|---|
| 3,554,099 | A | 1/1971 | Rodley | |
| 4,404,788 | A | 9/1983 | Svenang | |
| 5,178,469 | A * | 1/1993 | Collinson | 383/1 |
| 5,707,002 | A | 1/1998 | Miyamoto et al. | |
| 6,173,556 | B1 * | 1/2001 | Willard | B65B 7/02 53/247 |
| 7,328,540 | B1 * | 2/2008 | Rochon | B65B 43/123 53/131.4 |
| 7,413,301 | B2 | 8/2008 | Niimi et al. | |
| 2001/0002574 | A1 | 6/2001 | Miyazaki | |
| 2004/0093830 | A1 | 5/2004 | Miyazaki | |
| 2004/0094049 | A1 | 5/2004 | Miyazaki | |

(Continued)

FOREIGN PATENT DOCUMENTS

| | | |
|---|---|---|
| JP | 63-125120 A | 5/1988 |
| JP | 07-134508 A | 5/1995 |
| JP | 2000-264317 A | 9/2000 |

(Continued)

*Primary Examiner* — Stephen Meier
*Assistant Examiner* — Alexander D Shenderov
(74) *Attorney, Agent, or Firm* — Global IP Counselors, LLP

(57) ABSTRACT

A printing method includes printing on an outside surface of a packaging material which has an inside surface, the outside surface and an opening. The printing is performed in a state of the opening being closed.

7 Claims, 7 Drawing Sheets

(56) References Cited

U.S. PATENT DOCUMENTS

| | | | | |
|---|---|---|---|---|
| 2005/0158102 | A1 | 7/2005 | Miyazaki | |
| 2006/0152568 | A1 | 7/2006 | Niimi et al. | |
| 2007/0222803 | A1* | 9/2007 | Don et al. | 347/8 |
| 2011/0204563 | A1 | 8/2011 | Matsuhashi | |
| 2013/0307888 | A1 | 11/2013 | Matsuhashi | |

FOREIGN PATENT DOCUMENTS

| | | | |
|---|---|---|---|
| JP | 2001-163314 | A | 6/2001 |
| JP | 2001-261045 | A | 9/2001 |
| JP | 2004-284305 | A | 10/2004 |
| JP | 3116052 | U | 11/2005 |
| JP | 2011-173620 | A | 9/2011 |

* cited by examiner

PRINTING METHOD

CROSS-REFERENCE TO RELATED APPLICATIONS

This application is a continuation application of U.S. patent application Ser. No. 13/027,363 filed on Feb. 15, 2011. This application claims priority to Japanese Patent Application No. 2010-039142 filed on Feb. 24, 2010. The entire disclosures of U.S. patent application Ser. No. 13/027,363 and Japanese Patent Application No. 2010-039142 are hereby incorporated herein by reference.

BACKGROUND

1. Technical Field

The present invention relates to a printing method.

2. Related Art

Conventionally, inkjet printers which spray ink or another fluid onto a medium are widely known as recording apparatuses. Such printers have included those applied to printing manufacturing dates or other information, for example, on the external surfaces of bags for packaging foodstuffs and the like (Japanese Laid-Open Patent Application No. 2000-264317, for example).

When printing as a recording process is performed on a bag in this manner, the external surface used as the recording surface must be held in a flat state in the recording apparatus performing the recording process. Therefore, the recording apparatus (printing apparatus) of Japanese Laid-Open Patent Application No. 2000-264317 includes a pressing plate for pressing on the periphery of the printed portion of the bag.

SUMMARY

In Japanese Laid-Open Patent Application No. 2000-264317, the pressing plate, which is provided with a rectangular window hole, is used to press the bag so that the window hole matches up with the printed portion where the recording process will be performed. Therefore, it has sometimes been the case that the opening of the bag is closed along with the pressing of the bag by the pressing plate, and air remains inside the bag. There has been a problem with poor recording quality due to printing on a recording surface in which the remaining air has caused unevenness.

The present invention was devised in view of such problems described above, and an object thereof is to provide a printing method in which the bag can be kept closed. To achieve the objects described above, a printing method according to a first aspect of the present invention includes printing on an outside surface of a packaging material which has an inside surface, the outside surface and an opening, wherein the printing is performed in a state of the opening being closed.

BRIEF DESCRIPTION OF THE DRAWINGS

Referring now to the attached drawings which form a part of this original disclosure.

DETAILED DESCRIPTION OF EXEMPLARY EMBODIMENTS

First Embodiment

Figure 1:
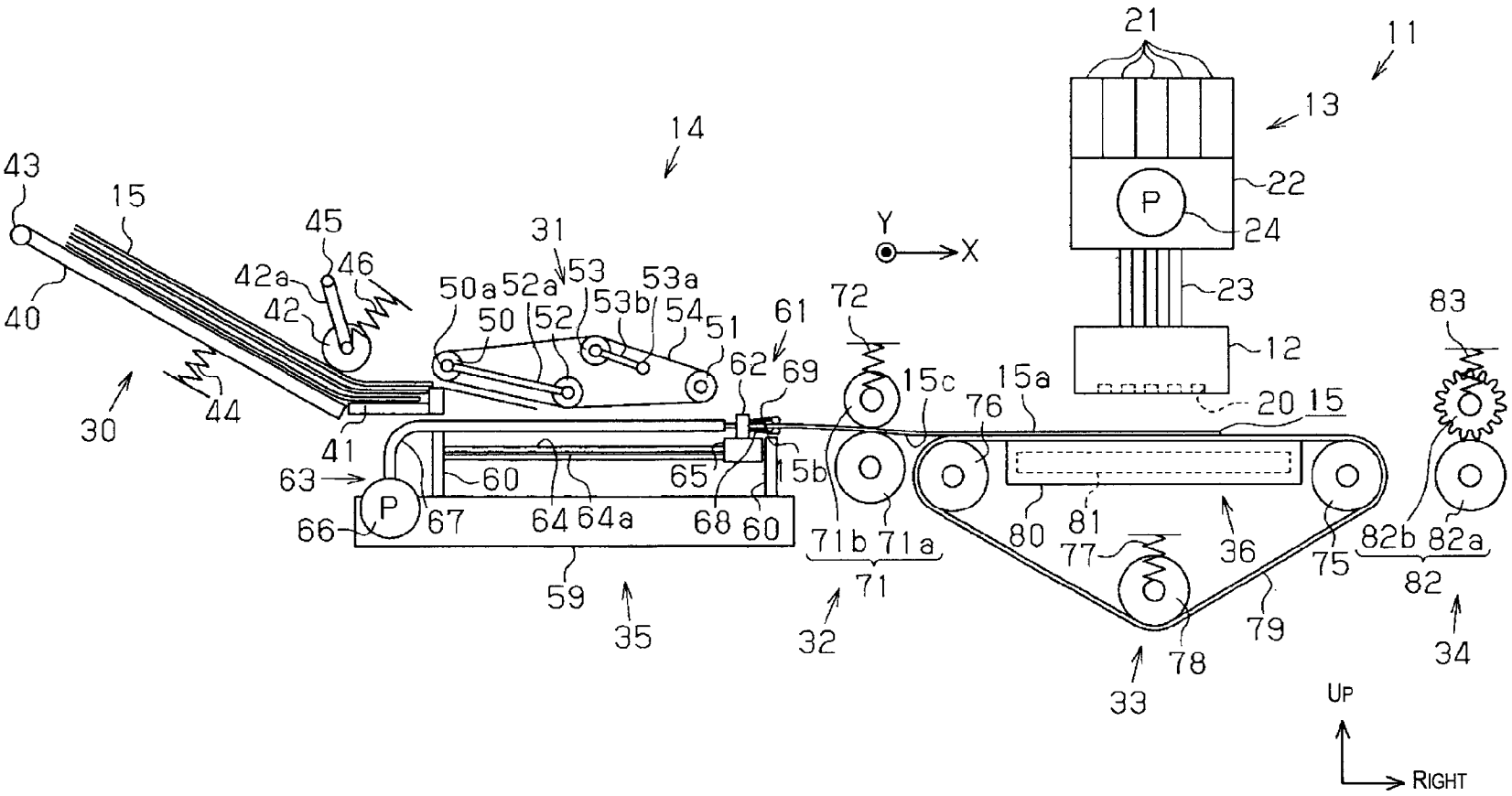
FIG. 1 is a front view showing the configuration of the recording apparatus in the first embodiment.

The first embodiment is described hereinbelow with reference to FIGS. 1 through 9, wherein the present invention is specified as an inkjet recording apparatus (hereinbelow referred to simply as "printer"), which is one type of a recording apparatus. In the description hereinbelow, the terms "forward-backward direction," "left-right direction," and "up-down direction," refer respectively to the forward-backward direction, left-right direction, and up-down direction indicated by the arrows in the drawings.

A printer 11 comprises a recording head 12 as a recording unit, an ink supply mechanism 13 for supplying ink as a fluid to the recording head 12, and a conveying apparatus 14, as shown in FIG. 1. The recording head 12 performs a recording process on a bag 15 made of a resin film or the like.

Figure 2:
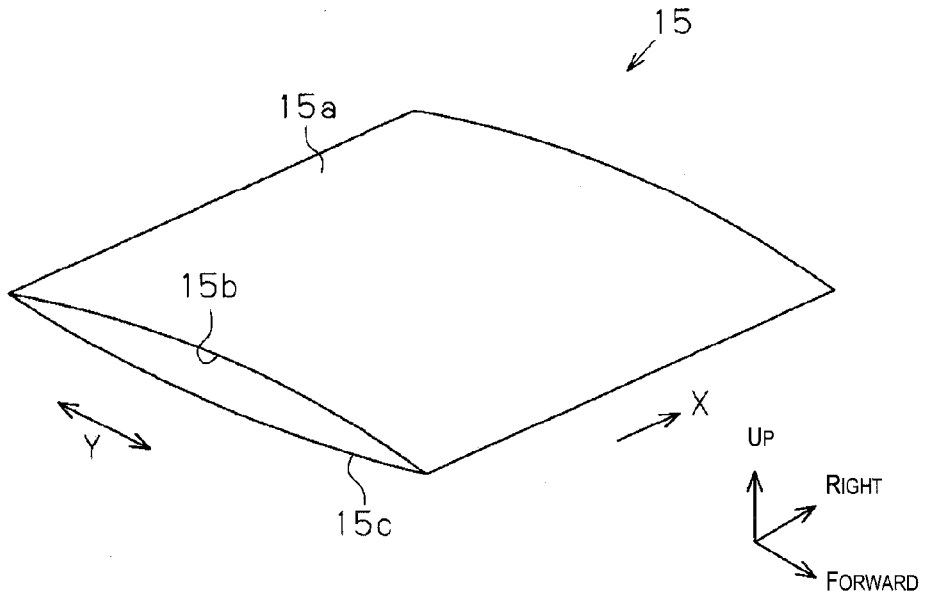
FIG. 2 is a perspective view showing a bag.

The bag 15 is used in order to package foodstuffs or the like, for example, wherein three of the four edges of vertically stacked sheets are sealed, and an opening 15*b* is formed in the remaining edge, as shown in FIG. 2. The conveying apparatus 14 conveys the bag 15 along a conveying direction X such that a top surface 15*a* of the bag 15 on which the recording process is performed faces upward, and the opening 15*b* is disposed toward the upstream side in the conveying direction X (to the right).

On the underside of the recording head 12, a plurality of nozzles 20 are provided for spraying ink droplets along the conveying direction X and the width direction Y (the forward-backward direction), as shown in FIG. 1. The ink supply mechanism 13 comprises a cartridge holder 22, an ink supply tube 23 connecting the cartridge holder 22 and the recording head 12, and a pressure pump 24. A plurality of ink cartridges 21 housing inks of different colors are removably installed in the cartridge holder 22.

The pressure pump 24 increases the pressure in the ink cartridges 21, whereby ink is supplied to the recording head 12 located downstream. Ink droplets are then sprayed from the nozzles 20 provided to the recording head 12 onto the top surface 15*a* of the bag 15 in the recording position, whereby the recording process is performed.

The conveying apparatus 14 comprises an unreeling portion 30, a first conveying portion 31, a second conveying portion 32 as a conveying mechanism, a third conveying portion 33, a fourth conveying portion 34, a suction mechanism 35, and a holding mechanism 36.

First, the configuration of the unreeling portion 30 is described.

The unreeling portion 30 comprises a hopper 40 disposed at an incline, an unreeling roller 42, and an unreeling guide 41. The hopper 40 is configured so as to be capable of turning about a turning shaft 43, and is urged from below by a compression spring 44. The unreeling roller 42 is turnably supported on a support arm 42*a* configured so as to be capable of turning about a turning shaft 45, and is urged by a support member 46 in a direction toward the hopper 40. The unreeling guide 41 is disposed downstream of the hopper 40 in the conveying direction X.

The hopper 40 is stocked with a plurality of stacked bags 15 prior to being subjected to the recording process. The bags 15 are stacked on the hopper 40 in an orientation such that the openings 15*b* are positioned on the upstream side in the conveying direction X.

Next, the configuration of the first conveying portion 31 is described.

The first conveying portion 31 comprises a drive roller 50, a driven roller 51, turning rollers 52, 53, a conveyor belt 54, and a suction mechanism (not shown). The turning roller 52 is turnably supported on the distal end of a support arm 52*a* configured to be capable of turning about a turning shaft 50*a*. The turning roller 53 is turnably supported on the distal end of a support arm 53*b* configured so as to be capable of turning about a support shaft 53*a*.

The turning rollers 52, 53 are designed to move in the up-down direction by the respective turning of the support arms 52*a*, 53*b*. The turning shaft 50*a* can be switched by a gear mechanism (not shown) between transmitting motive force to the drive roller 50 and transmitting motive force to the support arm 52*a*.

The conveyor belt 54 is wound around the drive roller 50, the driven roller 51, and the turning rollers 52, 53, and is stretched by the turning rollers 52, 53. A plurality of suction holes (not shown) are also formed in the conveyor belt 54.

The suction mechanism applies suction force to the suction holes of the conveyor belt 54, whereby a bag 15 unreeled by the unreeling portion 30 is held by suction on the underside of the conveyor belt 54. When the conveyor belt 54 moves circumferentially in the counterclockwise direction in FIG. 1 along with the rotatable driving of the drive roller 50, the bag 15 held by suction to the conveyor belt 54 is conveyed along the conveying direction X.

Next, the configuration of the suction mechanism 35 is described.

The suction mechanism 35 comprises a base stand 59, a guiding portion 61 supported on a pair of support members 60 rising from the base stand 59, a connecting mechanism 62, and a suction apparatus 63 for suctioning the interior of the bag 15.

The guiding portion 61 comprises a conveying route formation member 64 spanning between the support members 60, and a movement member 65 supported on the conveying route formation member 64. The conveying route formation member 64 guides the movement of the bag 15 along the conveying direction X on the top side, and guide rails 64*a* for guiding the movement member 65 are provided to the ends in the forward-backward direction. That is, the recording process is performed on the top surface 15*a* of the bag 15 in the recording position, while the bottom surface 15*c* (see FIG. 2) is guided to the conveying route formation member 64 in the conveying route.

The movement member 65 is capable of being moved back and forth by a drive mechanism (not shown) in the left-right direction along the guide rails 64*a*, in order to guide the movement of the connecting mechanism 62 along the conveying route of the bag 15. The conveying route formation member 64 is disposed underneath the conveyor belt 54 provided to the first conveying portion 31.

The suction apparatus 63 has a suction pump 66 fixed to the base stand 59, a suction tube 67 whose proximal end is connected to the suction pump 66, and a suction port 68 provided to the distal end of the suction tube 67.

The connecting mechanism 62 has a clip part 69 for clamping the proximity of the opening 15*b* of the bag 15 from the external sides so as to close the opening 15*b* of the bag 15 in a state in which the suction port 68 of the suction apparatus 63 is inserted into the opening 15*b* of the bag 15. The clip part 69 is supported on the movement member 65, and the connecting mechanism 62 opens and closes the clip part 69 with the desired timing by a drive mechanism (not shown). The connecting mechanism 62 is designed so as to connect the opening 15*b* of the bag 15 and the suction apparatus 63 by closing the clip part 69 in a state in which the suction port 68 of the suction apparatus 63 is inserted into the opening 15*b* of the bag 15.

Next, the configuration of the second conveying portion 32 is described.

The second conveying portion 32 has nip rollers 71 for conveying the bag 15 in a clamped state to a position farther downstream in the conveying direction X than the connecting mechanism 62. The nip rollers 71 are configured from a drive roller 71*a* for supporting the bag 15 from below, and a driven roller 71*b* constituting a pair with the drive roller 71*a*. The nip rollers 71 are formed into a cylindrical shape extending in the width direction Y, and the driven roller 71*b* is urged by an urging member 72 in a direction toward the drive roller 71*a*. The nip rollers 71 are formed so that the width in the width direction Y is longer than the width of the bag 15.

Next, the configurations of the third conveying portion 33 and the holding mechanism 36 are described.

The third conveying portion 33 comprises a drive roller 75, a driven roller 76, a driven roller 78 urged by an urging member 77, and a conveyor belt 79 wound around the drive roller 75 and the driven rollers 76, 78. The conveyor belt 79 is stretched by the urging force of the urging member 77, and is designed so as to move circumferentially in the clockwise direction in FIG. 1 along with the rotatable driving of the drive roller 75. A plurality of through-holes (not shown) are also formed in the conveyor belt 79.

The holding mechanism 36 comprises a platen 80 for supporting the bag 15 via the conveyor belt 79 in the recording position, and a suction mechanism 81 for holding the bag 15 on the conveyor belt 79 by suction through through-holes to the conveyor belt 79. In the third conveying portion 33 the recording process is performed while the bag 15 is held by suction to the platen 80, and the bag 15 on which the recording process has been performed on the top surface 15*a* is conveyed downstream along the conveying direction X along with the driving of the drive roller 75.

Next, the configuration of the fourth conveying portion 34 is described.

The fourth conveying portion 34 is provided with conveying rollers 82 for conveying the bag 15 in a clamped state. The conveying rollers 82 are configured from a drive roller 82*a* for supporting the bag 15 from below, and a driven roller 82*b* constituting a pair with the drive roller 82*a*. The driven roller 82*b* is urged by an urging member 83 in a direction toward the drive roller 82*a*.

The driven roller 82*b* is composed of a toothed gear roller in order to reduce the surface area in contact with the top surface 15*a* of the bag 15 that has been subjected to the recording process. The driven roller 82*b* has a shorter length in the width direction Y than the bag 15, and a plurality of driven rollers 82*b* is provided along the width direction Y.

Next, the action of the printer 11 is described.

When the recording process is performed, the distance separating the recording head 12 and the top surface 15*a* of the bag 15 must be kept constant. Therefore, the conveying apparatus 14 draws out the air that is the source of unevenness by suctioning the interior of the bag 15 by means of the suction mechanism 35, and the bag 15 is conveyed in a state of negative pressure inside the bag 15. The bag 15 is thereby conveyed to the recording process while being held in a flat state.

Figure 3:
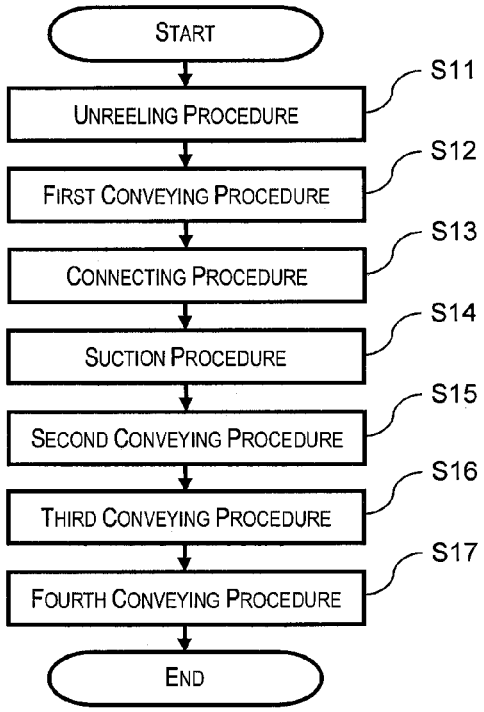
FIG. 3 is a flowchart showing the conveying method in the first embodiment.

The conveying method in the conveying apparatus 14 involves the following sequence as shown in FIG. 3: an unreeling procedure of step S11, a first conveying procedure of step S12, a connecting procedure of step S13, a suction procedure of step S14, a second conveying procedure of step S15, a third conveying procedure of step S16, and a fourth conveying procedure of step S17. A recording procedure for performing the recording process on the top surface 15*a* of the bag 15 is performed in the third conveying procedure of step S16 as the recording method of the printer 11.

First, as the unreeling procedure of step S11, in the unreeling portion 30, the unreeling roller 42 is rotatably driven while the unreeling roller 42 is in contact with the bag 15 located on top of the bags 15 stacked on the hopper 40. The bags 15 are thereby unreeled one at a time from the hopper 40 as shown in FIG. 1. The unreeled bag 15 is then guided by the unreeling guide 41 to a position below the first conveying portion 31.

Figure 4:
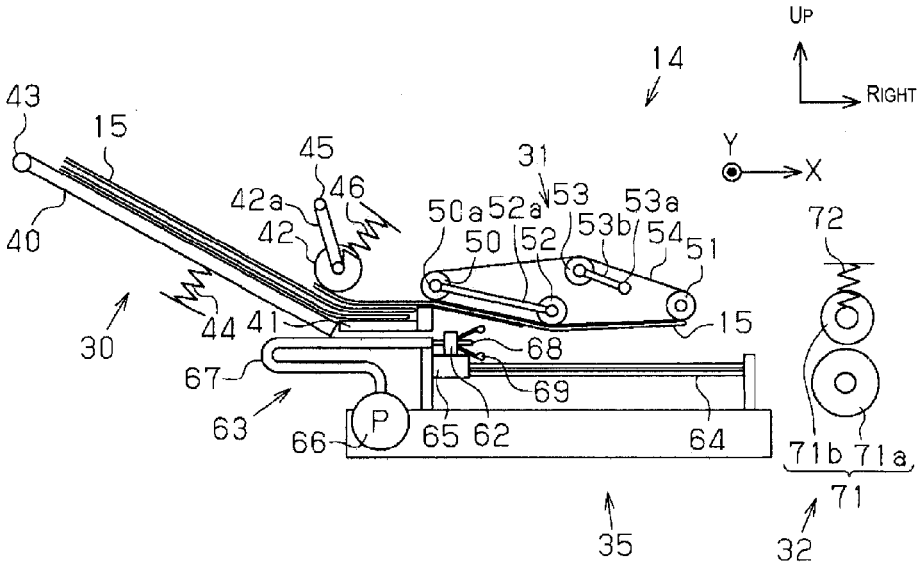
FIG. 4 is a front view showing the bag being conveyed by the first conveying portion in the first conveying procedure.

Next, as the first conveying procedure of step S12, the first conveying portion 31 conveys the bag 15 unreeled from the unreeling portion 30 to the connecting position where the suction mechanism 35 is provided. In the first conveying procedure, first, the drive roller 50 of the first conveying portion 31 and the suction mechanism are driven. The bag 15 unreeled by the unreeling portion 30 is thereby held by suction to the underside of the conveyor belt 54 as shown in FIG. 4, and the bag 15 held by suction to the conveyor belt 54 is conveyed along the conveying direction X.

Figure 5:
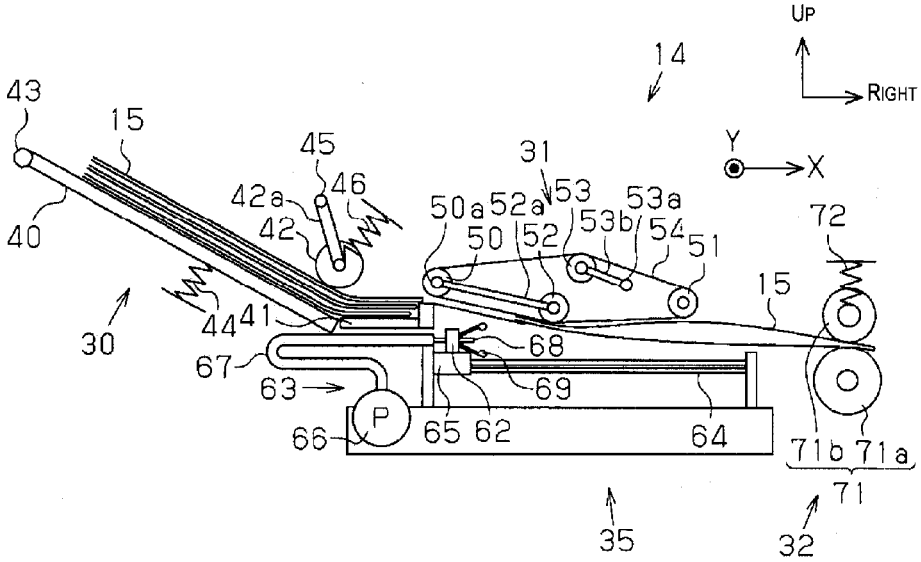
FIG. 5 is a front view showing the distal end of the bag being clamped in the nip rollers of the second conveying portion in the first conveying procedure.

The first conveying portion 31 stops the driving of the drive roller 50 and the suction mechanism at the stage when the distal end of the bag 15 is clamped by the nip rollers 71 of the second conveying portion 32, as shown in FIG. 5. The bag 15 held by suction to the conveyor belt 54 thereby falls onto the conveying route formation member 64 positioned below. At this time, the clip part 69 is in an open state, and the movement member 65 supporting the clip part 69 is in standby at the left end of the conveying route formation member 64.

Figure 6:
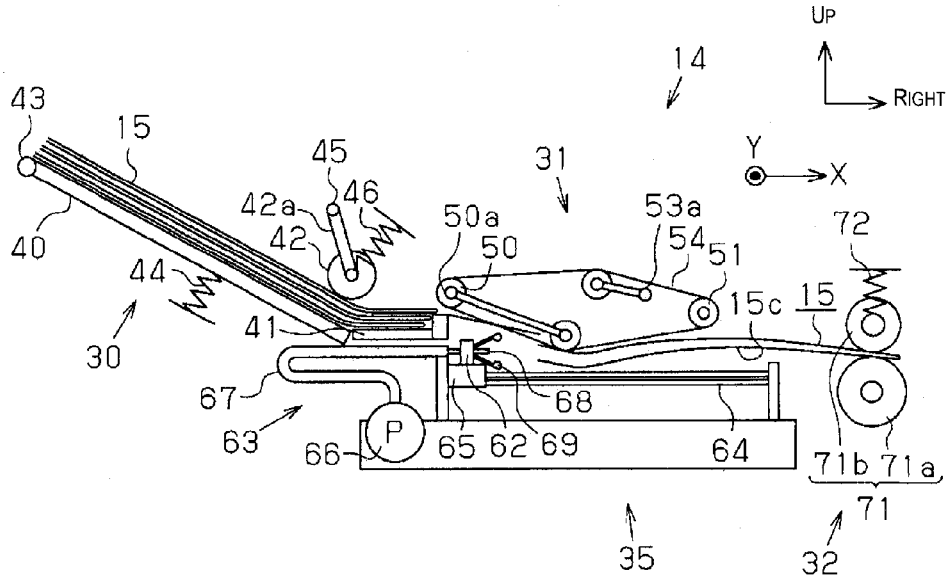
FIG. 6 is a front view showing the bag being disposed in the connecting position in the first conveying procedure.

Next, the turning rollers 52, 53 of the first conveying portion 31 move downward as shown in FIG. 6. The bag 15 is thereby pressed downward and disposed in the connecting position where connection with the suction apparatus 63 will take place. When the bag 15 is disposed in the connecting position, the turning rollers 52, 53 move upward and return to their original positions.

Figure 7:
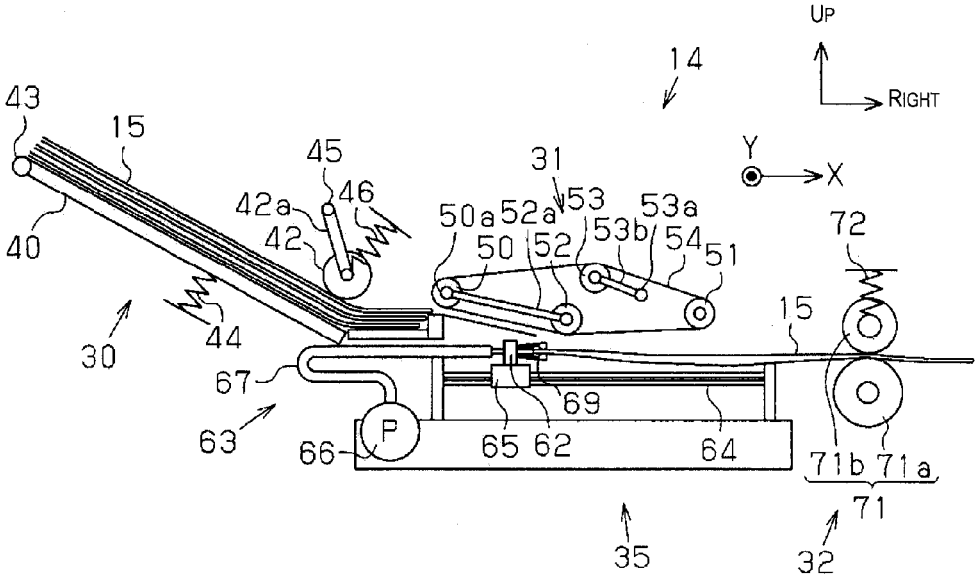
FIG. 7 is a front view for illustrating the connecting procedure.

Next, in the connecting procedure of step S13, the movement member 65 moves to the right toward the connecting position. In the connecting position, when the suction port 68 of the suction apparatus 63 is inserted into the opening 15*b* of the bag 15, the movement member 65 ceases movement, and the connecting mechanism 62 closes the clip part 69 as shown in FIG. 7. The opening 15*b* of the bag 15 is thereby closed in a state in which the clip part 69 is clamping the proximity of the opening 15*b* of the bag 15 from the external sides, and the connection between the suction apparatus 63 and the bag 15 is complete.

Figure 8:
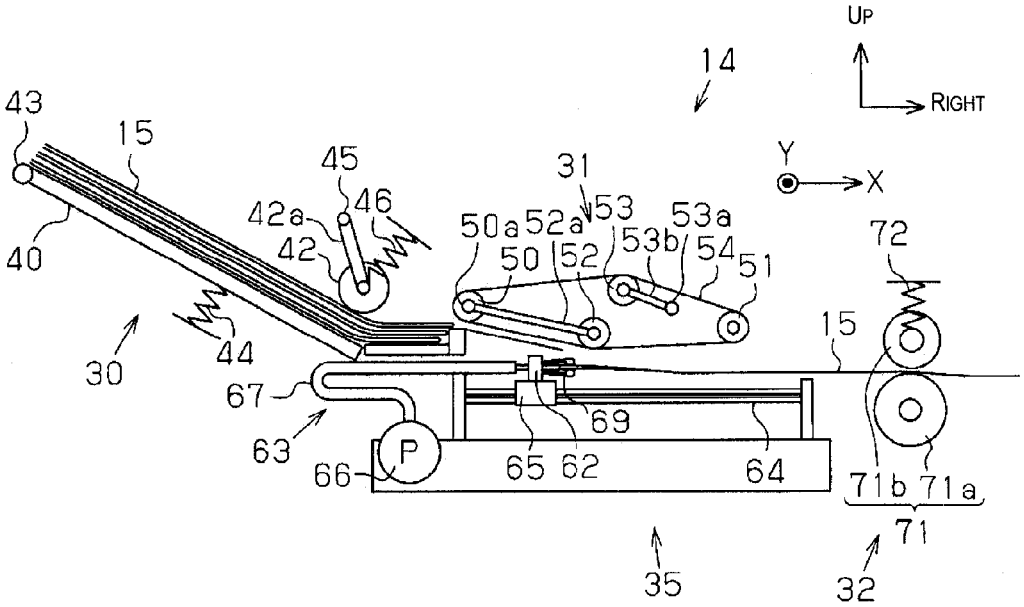
FIG. 8 is a front view for illustrating the suction procedure.

Next, as the suction procedure of step S14, the suction apparatus 63 drives the suction pump 66, whereby the interior of the bag 15 is suctioned via the suction tube 67 and the suction port 68. Negative pressure is thereby created inside the bag 15, and the upper and lower inside surfaces of the bag 15 adhere together, making the bag 15 flat as shown in FIG. 8.

Figure 9:
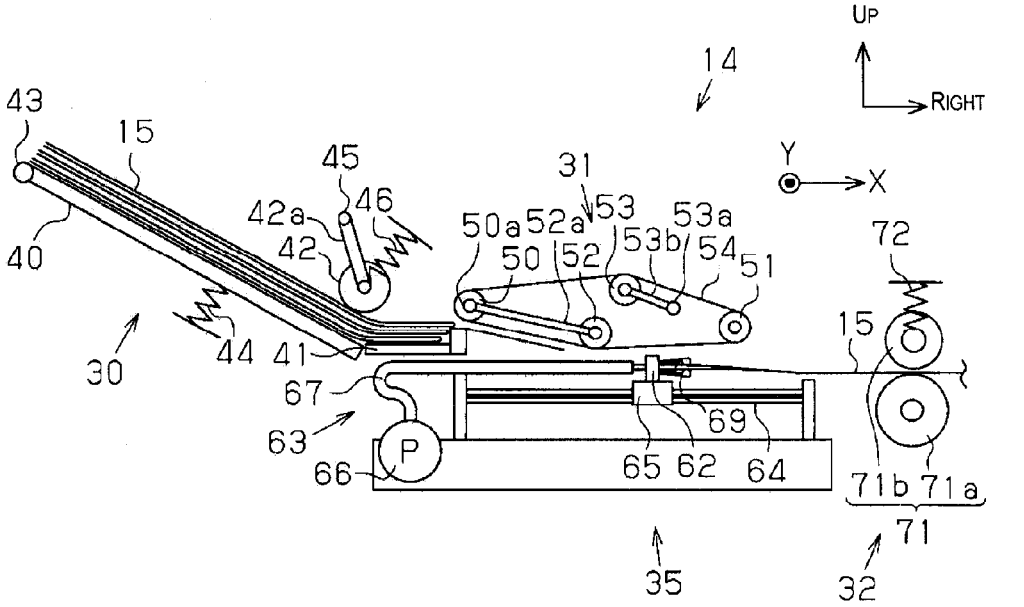
FIG. 9 is a front view for illustrating the second conveying procedure.

Next, as the second conveying procedure of step S15, the second conveying portion 32 drives the drive roller 71*a* and conveys the bag 15 to which the suction apparatus 63 is connected along the conveying direction X toward the recording position, as shown in FIG. 9. At this time, the movement member 65 also moves along the conveying direction X along with the conveying of the bag 15. The bag 15 is thereby conveyed while its interior is kept in a state of negative pressure.

When the movement member 65 reaches the right end of the guide rails 64*a* as shown in FIG. 1, the connecting mechanism 62 opens the clip part 69 and releases the connection between the bag 15 and the suction apparatus 63. That is, after the interior of the bag 15 is suctioned by the suction pump 66 and the distal end of the bag 15 is clamped by the nip rollers 71, the connecting mechanism 62 releases the connection between the opening 15*b* and the suction pump 66. At this time, since the distal end of the bag 15 is clamped by the nip rollers 71, air is prevented by the nip rollers 71 from entering through the distal end even when the connection with the suction pump 66 is released and the opening 15*b* is opened.

Next, as the recording procedure in the third conveying procedure of step S16, the drive roller 75 of the third conveying portion 33 and the suction mechanism 81 of the holding mechanism 36 are driven. The bag 15 is thereby conveyed along the conveying direction X while being held by suction on the conveyor belt 79, and the recording process is performed on the top surface 15*a* of the bag 15 in the recording position.

Lastly, as the fourth conveying procedure of step S17, the drive roller 82*a* of the fourth conveying portion 34 is driven. The bag 15, having had the recording process performed on its top surface 15*a*, is thereby conveyed from the recording position and the recording process is ended. The drive roller 71*a* of the second conveying portion 32, the drive roller 75 of the third conveying portion 33, the suction mechanism 81 of the holding mechanism 36, and the drive roller 82*a* of the fourth conveying portion 34 may be simultaneously driven. That is, the second through fourth conveying procedures may be performed simultaneously.

According to the embodiment described above, the following effects can be achieved.

(1) In the suction procedure, negative pressure can be created inside the bag 15 and the bag 15 can be flattened by the suctioning of the interior of the bag 15 by the suction mechanism 35.

(2) In the second conveying procedure, since the second conveying portion 32 conveys the bag 15 in a state in which the suction mechanism 35 has been connected via the connecting mechanism 62, the bag 15 can be held flat in the recording position. When the bag 15 is conveyed, the movement of the connecting mechanism 62 along the conveying route can be guided by the guiding portion 61.

(3) Since the connecting mechanism 62 has the clip part 69 for clamping the proximity of the opening 15*b* of the bag 15 from the external sides, the opening 15*b* of the bag 15 can be closed in a state in which the suction port 68 of the suction mechanism 35 has been inserted into the opening 15*b* of the bag 15. Since the suction tube 67 connected at the proximal end to the suction pump 66 is flexible, the suction port 68 can be allowed to move along with the conveying of the bag 15.

(4) Since the bag 15 is conveyed in a state such that the opening 15*b* is disposed at the rear end, which is upstream in the conveying direction X, the distal end can be clamped by the nip rollers 71 provided downstream in the conveying direction X while the interior is suctioned from the rear end where the suction mechanism 35 is connected. The bag 15 is clamped by the nip rollers 71, whereby the bag 15 can be conveyed while being kept in a flat state.

(5) Since the connecting mechanism 62 releases the connection between the opening 15*b* of the bag 15 and the suction mechanism 35 after the interior of the bag 15 has been suctioned by the suction mechanism 35 and the distal end of the bag 15 has been clamped by the nip rollers 71, the bag 15 can be clamped by the nip rollers 71 after the bag 15 has been flattened.

(6) Since the second conveying portion 32 conveys the bag 15 from the connecting position to the recording position while the suction mechanism 35 remains connected via the connecting mechanism 62, the bag 15 can be conveyed while the interior is being suctioned by the suction mechanism 35. Therefore, negative pressure is created inside the bag 15, whereby the bag 15 can be conveyed while being kept flat. Thereby, when the recording head 12 performs the recording process on the external surface of the bag 15, the external surface of the bag 15 constituting the recording surface is kept flat, and a decrease in recording quality caused by the recording surface being uneven can therefore be prevented.

(7) Since the recording process is performed on the top surface 15*a* of the bag 15 in the recording position, the top surface 15*a* is not subjected to any loads from sliding even when the bottom surface 15*c* is guided to the conveying route formation member 64 of the guiding portion 61 in the conveying route.

Second Embodiment

Figure 10:
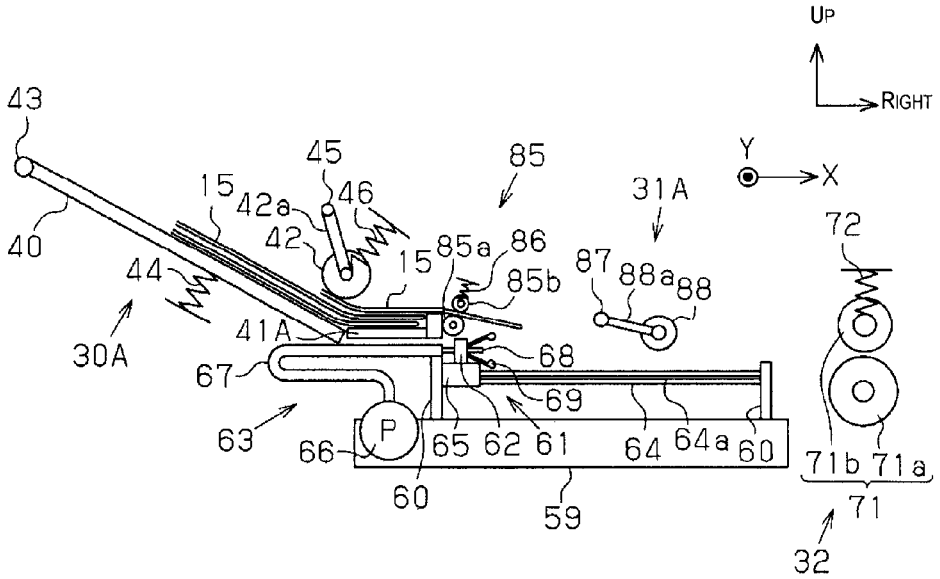
FIG. 10 is a front view showing the configuration of the conveying apparatus in the second embodiment.
Figure 11:
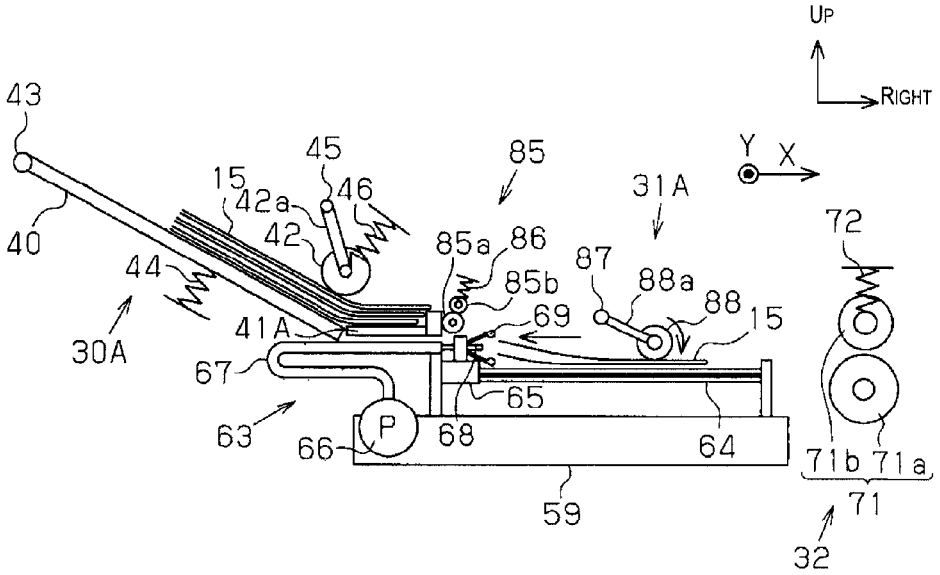
FIG. 11 is a front view for illustrating the action of the conveying apparatus in the second embodiment.
Figure 12:
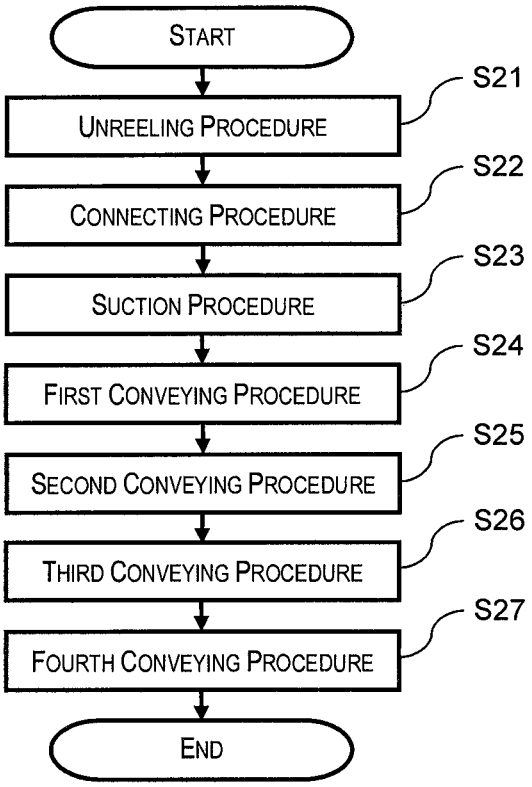
FIG. 12 is a flowchart showing the conveying method in the second embodiment.

The following is a description of the second embodiment, made with reference to FIGS. 10 through 12, wherein the configurations of the unreeling portion 30 and the first conveying portion 31 have been changed from those in the printer 11 of the first embodiment. The other portions are identical to the first embodiment, and drawings and descriptions thereof are therefore omitted.

An unreeling portion 30A of the present embodiment comprises supply rollers 85 to the right of an unreeling guide 41A, as shown in FIG. 10. The supply rollers 85 are configured from a drive roller 85*a* for supporting the bag 15 from below, and a driven roller 85*b* constituting a pair with the drive roller 85*a*. The driven roller 85*b* is urged by an urging member 86 in a direction toward the drive roller 85*a*. The urging direction of the driven roller 85*b* in relation to the drive roller 85*a* is adjusted in order for the supply rollers 85 to supply the bag 15 to the conveying route formation member 64 positioned below.

A first conveying portion 31A of the present embodiment comprises a turning shaft 87 provided above the conveying route formation member 64, a support arm 88*a* capable of turning about the turning shaft 87, and a conveying roller 88 turnably supported on the distal end of the support arm. The conveying roller 88 is designed so as to move in the up-down direction by the turning of the support arm 88*a*.

The conveying roller 88 conveys the bag 15 to the right in the conveying direction X by turning in a forward direction (the counterclockwise direction in FIG. 10). The conveying roller 88 is also designed so as to convey the bag 15 to the left by rotating in a reverse direction (the clockwise direction in the drawings), as shown in FIG. 11.

Next, the conveying method of the bag 15 in the present embodiment is described.

First, as the unreeling procedure of step S21, in the unreeling portion 30A, the unreeling roller 42 is rotatably driven while the unreeling roller 42 is in contact with the bag 15 located on top of the bags 15 stacked on the hopper 40, as shown in FIG. 12. The bag 15 located at the top of the stacked bags 15 is thereby separated. The drive roller 85*a* of the supply rollers 85 is also rotatably driven. The separated bag 15 is thereby disposed on top of the conveying route formation member 64 while being clamped in the supply rollers 85.

Next, as the connecting procedure of step S22, the support arm 88*a* turns in the clockwise direction in the drawings as shown in FIG. 11, and the conveying roller 88 rotates in the reverse direction. The conveying roller 88 thereby moves downward, coming in contact with the bag 15, and the bag 15 is conveyed to a connecting position where the suction port 68 of the suction apparatus 63 is inserted into the opening 15*b* of the bag 15.

In the connecting position, when the suction port 68 of the suction apparatus 63 is inserted into the opening 15*b* of the bag 15, the conveying roller 88 stops rotating, and the connecting mechanism 62 closes the clip part 69. The opening 15*b* of the bag 15 is thereby closed in a state in which the clip part 69 is clamping the proximity of the opening 15*b* of the bag 15 from the external sides, and the connection between the suction apparatus 63 and the bag 15 is complete.

Next, as the suction procedure of step S23, the suction apparatus 63 drives the suction pump 66, whereby the interior of the bag 15 is suctioned via the suction tube 67 and the suction port 68. Negative pressure is thereby created inside the bag 15, and the inside surfaces of the top and bottom sides of the bag 15 adhere together, flattening the bag 15.

Next, as the first conveying procedure of step S24, the conveying roller 88 rotates in the forward direction and the movement member 65 moves to the right. The bag 15 to which the suction port 68 is connected is thereby conveyed along the conveying direction X, the movement of the connecting mechanism 62 is guided along the conveying route, and the bag 15 is therefore conveyed while negative pressure is being maintained in its interior. That is, in the present embodiment, the first conveying portion 31 A functions as a conveying mechanism.

When the distal end of the bag 15 is clamped by the nip rollers 71 of the second conveying portion 32, the rotation of the conveying roller 88 in the forward direction is ended. The support arm 88*a* also turns in the counterclockwise direction in FIG. 10, whereby the conveying roller 88 moves away from the bag 15.

Next, as the second conveying procedure in step S25, the second conveying portion 32 drives the drive roller 71*a*, and the bag 15 to which the suction port 68 is connected is conveyed along the conveying direction X toward the recording position. In the first conveying procedure and the second conveying procedure, in the stage at which the movement member 65 has reached the right end of the guide rails 64*a*, the movement member 65 stops moving and the connecting mechanism 62 opens the clip part 69, releasing the connection between the bag 15 and the suction apparatus 63.

The subsequent third conveying procedure (step S26), recording procedure, and fourth conveying procedure (step S27) are the same as in the first embodiment.

According to the embodiment described above, the following effects can be achieved in addition to the same effects in (1) through (7) described above.

(8) Since the first conveying portion 31A has no suction mechanism, the configuration can be simplified.

The embodiment described above may also be modified to other embodiments such as the following.

The conveying apparatus 14 is preferably capable of conveying a bag 15 while the suction apparatus 63 remains connected via the connecting mechanism 62, and the configurations of the first through fourth conveying portions can be changed as desired, or any of the conveying portions may be omitted.

The suction mechanism 35 is preferably configured such that the suction port 68 can follow the conveying of the bag 15; for example, the suction apparatus 63 may move along the conveying direction X. In this case, there is no need for the suction tube 67 to be led along.

A plurality of suction ports 68 may be provided to the suction mechanism 35, and they may be designed to be capable of suctioning the interior of a plurality of bags 15 simultaneously. According to this configuration, the efficiency of the process can be improved.

The conveying method preferably includes a connecting procedure for connecting the opening 15*b* of the bag 15 and the suction apparatus 63, and a suction procedure for suctioning the interior of the bag 15 after the connecting procedure. For example, the bag 15 and the suction apparatus 63 may be connected before the unreeling portion 30 unreels the bag 15.

The bag 15 may be conveyed with the opening 15*b* facing either forward or backward. In this case, the connecting mechanism 62 is preferably disposed either in front of or behind the conveying route formation member 64. According to this configuration, the bag 15 can be kept flat throughout a plurality of procedures, not only in the recording process but in the subsequent drying process and the like as well. That is, the conveying apparatus 14 may be designed so as to convey the bag 15 to which the suction apparatus 63 is connected to a plurality of processing positions.

A seal mechanism for temporarily sealing the opening 15*b* of the bag 15 may be provided, and the opening 15*b* of the bag 15 may be sealed before the connection between the bag 15 and the suction apparatus 63 is released. According to this configuration, air can be prevented from entering the bag 15 even if conveying is performed after the connection between the bag 15 and the suction apparatus 63 is released.

The application of the conveying apparatus 14 is not limited to conveying the bag 15 to the recording position, and the conveying apparatus 14 can also be applied to conveying the bag 15 to other working positions of various procedures, e.g., applying a seal to the external surfaces of the bag 15, transferring a foil, measuring size, drying, and inspecting the results of these processes.

The guiding portion 61 need not be provided, and the suction mechanism 35 and the bag 15 may be connected in the recording position. In this case as well, the bag 15 can be kept flat during the recording process by suctioning the interior of the bag 15 by the suction pump 66 before the recording process.

The bag preferably has an opening for suctioning the interior, and the bags, which are not limited to rectangular shapes, can have any desired shape or material.

The ink cartridges 21 may also be ink tanks which cannot be removed.

The printer 11 may be embodied as a full line head type of line head printer comprising a rectangular fluid spray head, a lateral printer, or a serial printer.

In the embodiment described above, the recording apparatus is specified as an inkjet printer, but a fluid-spraying apparatus that sprays or discharges a fluid other than ink may be used, and the present invention can be applied to various liquid-spraying apparatuses comprising a liquid spray head or the like for discharging microscopic droplets. The term "droplets" refers to the state of the liquid discharged from the liquid-spraying apparatus, and includes that which leaves trails of grains, tears, or threads. The liquid referred to herein need only be a substance that can be sprayed by the liquid-spraying apparatus. For example, the material need only be in the state of a liquid which includes not only fluids such as liquids of high and low viscosity, sols, gels, other inorganic solvents, organic solvents, solutions, liquid resins, and liquid metals (metal melts); and liquids as one state of the substance; but also includes liquids containing functional materials composed of pigments, metal particles, or the like which are dissolved, dispersed, or mixed in a solvent. Typical examples of the liquids include ink such as the ink described in the embodiment described above, liquid crystal, and the like. The term "ink" used herein includes common water-based ink and oil-based ink, as well as gel ink, hot melt ink, and other various liquid compositions. Specific examples of the liquid-spraying apparatus include liquid-spraying apparatuses which spray a liquid containing an electrode material, a coloring material, or the like in the form of a dispersion or a solvent, which is used in the manufacture of liquid crystal displays, EL (electroluminescence) displays, surface-emitting displays, color filters, and the like, for example; liquid-spraying apparatuses which spray a biological organic substance used to manufacture biochips; liquid-spraying apparatuses which are used as precision pipettes and which spray a liquid as a test sample; printing apparatuses, micro dispensers; and the like. Further options which may be used include liquid-spraying apparatuses which spray lubricating oil at pinpoints onto watches, cameras, and other precision instruments; liquid-spraying apparatuses for spraying an ultraviolet curing resin or another transparent resin liquid onto a substrate in order to form a microscopic semispherical lens (optical lens) or the like used in an optical communication element or the like; and liquid-spraying apparatuses for spraying an acid, and alkali, or another etching liquid in order to etch a substrate or the like. The present invention can be applied to any one of these types of spraying apparatuses.

General Interpretation of Terms

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Finally, terms of degree such as "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. A printing method comprising:

conveying, in a conveying direction, a packaging material having a body with an inside surface, an outside surface, an opening portion disposed at one end of the body, and an opposite end portion disposed at an opposite end of the body, the opposite end being opposite the one end in the conveying direction; and printing on the outside surface while conveying the packaging material in a state of the opening portion being positioned upstream in the conveying direction relative to the opposite end portion, the printing being performed in a state of the opening portion being closed.

2. The printing method according to claim 1, wherein the printing is performed in the state of the opening being sealed.

3. The printing method according to claim 1, wherein the printing is performed in the state of the opening being closed by using other member.

4. The printing method according to claim 3, wherein the printing is performed in the state of the opening being clamped by using the other member.

5. The printing method according to claim 3, wherein the printing is performed in the state of the opening being closed by inserting the other member in the opening.

6. The printing method according to claim 1, wherein the packaging material is a bag.

7. The printing method according to claim 1, wherein the packaging material is for foodstuff.

* * * * *